US005339499A

United States Patent [19]

Kennedy et al.

[11] Patent Number: 5,339,499

[45] Date of Patent: Aug. 23, 1994

[54] HOOK DESIGN FOR A HOOK AND LOOP FASTENER

[75] Inventors: William J. Kennedy, Charleston, S.C.; Gerald F. Rocha, Bedford, N.H.

[73] Assignee: Velcro Industries B.V., Amsterdam, Netherlands

[21] Appl. No.: 17,749

[22] Filed: Feb. 16, 1993

[51] Int. Cl.[5] ..... A44B 13/00

[52] U.S. Cl. ..... 24/452; 24/442; 24/450

[58] Field of Search ..... 24/452, 451, 450, 449, 24/448, 442, 306; 428/100

[56] References Cited

U.S. PATENT DOCUMENTS

| | | | |
|---|---|---|---|
| 3,009,235 | 11/1961 | Mestral | 28/78 |
| 3,147,528 | 9/1964 | Erb | 24/204 |
| 3,261,069 | 7/1966 | Mathison | 24/204 |
| 3,266,113 | 8/1966 | Flanagan, Jr. | 24/452 |
| 3,312,583 | 4/1967 | Rochlis | 161/62 |
| 3,708,833 | 1/1973 | Ribich et al. | 24/204 |
| 3,762,000 | 10/1973 | Menzin et al. | 24/204 |
| 3,868,648 | 5/1974 | Billarant et al. | 24/450 |
| 3,879,835 | 4/1975 | Brumlik | 29/412 |
| 4,872,243 | 10/1989 | Fischer | 24/442 |
| 4,894,260 | 1/1990 | Nestegard | 24/442 |
| 4,901,204 | 2/1990 | Hayashi | 361/417 |
| 4,984,339 | 1/1991 | Provost et al. | 24/452 |
| 5,067,210 | 11/1991 | Kayaki | 24/442 |
| 5,131,119 | 7/1992 | Murasaki et al. | 24/452 |

*Primary Examiner*—Victor M. Sakran

*Attorney, Agent, or Firm*—Hayes, Soloway, Hennessey, Grossman & Hage

[57] ABSTRACT

This invention describes a hook design for the hook portion of a hook and loop fastener system, and the hook strip made up of a multiplicity of such hooks projecting from a common base. The hook design encompasses a thickened stem portion projecting from the base and connecting to lobes of a crook portion at a neck. The stem portion is substantially thicker than the crook portion and terminates at the neck. The lobes and the stem are tapered whereby the hook can be easily withdrawn from its mold cavity during the molding operation. The hook is characterized by improved engageability and closure performance.

14 Claims, 6 Drawing Sheets

HOOK DESIGN FOR A HOOK AND LOOP FASTENER

FIELD OF THE INVENTION

This invention relates to an improved design for a hook intended to be used as the hook portion of a hook and loop fastener. More particularly it is a design for a plastic molded hook; the bottom portion of which is attached to a flat continuous plastic strip of extended length and finite width containing many hooks thereon, the strip acting as a base for said hooks. The crook portion of the hook is attached to a stem portion projecting upwards from the base and connected to the crook portion at a neck portion from which dual lobes of the crook project outward, orientated generally parallel to the running length of the strip. The stem portion is substantially thicker than the crook portion which provides many advantages as will be described herein.

DESCRIPTION OF THE RELATED ART

Hock and loop fasteners are well known in the art. U.S. Pat. No. 3,009,235, to G. De Mestral, describes a product produced by textile fabricating techniques which is sold under the registered trademark VELCRO. Many advances of the textile forming method have been patented over the years, but the limitations of the textile techniques as to product flexibility, process efficiency and manufacturing costs have directed an interest in forming hooks by plastic molding methods. Molding methods and the products from such methods are described in U.S. Pat. No. 3,147,528 to Erb; U.S. Pat. No. 3,762,000 to Menzin et al. and U.S. Pat. No. 4,872,243 to Fischer, all assigned to the assignee of the instant invention. U.S. Pat. No. 3,312,583 to Rochlis describes alternate methods of producing such molded hooks and illustrates several designs which resemble hooks generally similar to molded hooks utilized in hook and loop fasteners.

U.S. Pat. No. 4,984,339 to Provost et al., also assigned to the assignee of the instant invention, describes an improved hook design wherein the hook tapers smoothly and continuously downward in width from the sturdy base member to the free end such that a loop engaging the hook in tension with the applied force being substantially normal to the base member, will deform the hook portion resiliently under the applied force to release the loop at a desired applied force such that a loop engaging the hook in shear, with the applied force substantially parallel to the base member, will engage the sturdy base member such that it will not deform to release a loop engaging the hook in shear at or below the desired applied force.

U. S. Pat. No. 5,131,119 to Ryuichi Murasaki et al. describes a similar hook element with a gentle slope, a front portion extending at least partially straight from a flat base, a standing portion having at least one side accompanying a reinforcing rib extending from the flat base and a hook head extending forwardly from the standing portion, each hook element having a varying cross section area increasing gradually from the hook head toward the flat base.

U. S. Pat. No. 3,708,833 to Ribich and assigned to the assignee of the instant invention, describes engaging elements comprising flexible spear-like protuberances each having a stem supported at one end thereof on a base and on the unsupported end of the stem a flexible spear-like head having at least two opposite radial extensions which slope from the end of the stem toward the base and extend away from the stem and are resiliently flexible in a plane parallel to the plane of the stem. The particular design is claimed to be especially valuable for engaging reticulated foam as the companion element of the fastening system. While the design of Ribich provides excellent properties for a hook of a hook and loop fastening system, it is a very complex shape having multiple planes, tapers axed angles which require complex and expensive molds to create. One of the objects of the instant invention is to develop a shape with many of the performance advantages of the Ribich design but requiring a much simpler, more economical mold design.

BRIEF SUMMARY OF THE INVENTION

The closure performance of hook and loop systems is generally evaluated by strength measurements encountered in separating the hook strip from the loop strip. Such measurements are referred to as tension when the forces are applied perpendicular to the plane of the base of the fastener strip and shear when the forces are applied parallel to the plane of the base of the fastener strip. Shear forces may be applied either along the long dimension of the strip, referred to as the machine direction, or perpendicular to the machine direction, referred to as the cross direction. When the strips are disengaged continuously along their length, or peeled apart, the performance is referred to as peel force.

Another aspect of the performance of a hook and loop system relates to the ability of the two companion elements to engage each other and is referred to herein as engagement and engagement force. Little attention has been devoted to the problems of engagement in the published art. As used herein, engagement force is the force required to press the fastener strips together. Once pressed together, the force to separate them is the separation force. Generally speaking, separation force is increased as engagement force increases. The shape of the top of a hook will have something to do with the amount of force required to engage the companion strips of a hook and loop closure.

Plastic molded hooks are formed in molds cut in the shape desired for the hook. Hook strips of a hook and loop fastening system contain a multiplicity of hooks projecting from a common base. Each hook requires its own individual mold cavity. Complex shapes which require extensive machining or etching of the mold cavity are costly and the number of hooks normally utilized on a hook strip accentuates the cost. It is therefore desirable to design a hook shape with a minimum of unusual shapes. It is one object of the present invention to produce a relatively simple hook shape with the performance characteristics of a much more complex shape.

This objective is satisfied by an improved plastic molded hook design which comprises a flat base, a stem connected from the base and projecting upwards therefrom, a neck portion connecting the stem to a crook portion, the crook portion having at least one lobe projecting from the stem at the neck in a plane generally parallel to the base. The lobe is designed with a continuously decreasing vertical thickness from its base at the neck to its tip. The neck has a width at least equal to the vertical thickness of the lobe at its thickest point. The stem portion has substantially greater lateral thickness than the crook portion and extends from the base upward to the neck from which a thinner crook projects. The width of the stem is also configured with a continuous decreasing width from the neck to the base. The laterally thickened stem projects upwards to the neck which lies above a point on the stem which is the point of stress concentration when the lobe is opened by a loop when two fastener strips are separated.

In another embodiment of the invention, twin crook lobes project from the neck in opposite directions, the plane of the lobes generally aligned with the machine direction of the hook strip. The lobes are designed with a continuously decreasing vertical thickness from their base at the neck to their tips. The neck has a width at least equal to two times the vertical thickness of a lobe at its thickest point. The stem portion has substantially greater lateral thickness than the crook portion and extends from the base upward to the neck from which the thinner crooks projects. The width of the stem is also configured with a continuous decreasing width from its base up to the neck. The laterally thickened stem projects upwards to the neck which lies above a point on the stem which is the point of stress concentration when at least one of the lobes is opened by a loop when two fastener Strips are separated.

The geometry of the hooks described can be made from very simple molds as compared to hook designs with many complex surfaces and undercuts. The continuously decreasing taper from the base to the tip of the crook of the hook permits easy removal of the hook from its mold, and the broadened stem does not interfere with the hook being pulled from its mold. Yet the broadened stem, as will become evident, contributes to substantially improved engagement of the hooks of this design and substantially improved closure performance.

DETAILED DESCRIPTION OF THE INVENTION

Figure 1:
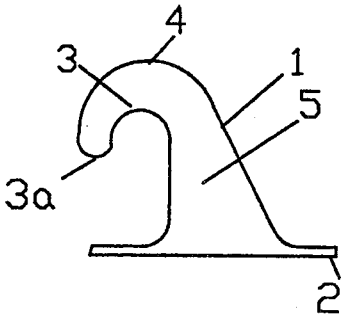
Fig. 1 Prior Art
FIG. 1 shows a prior art hook design described by Provost in U.S. Pat. No. 4,984,339.
Figure 1A:
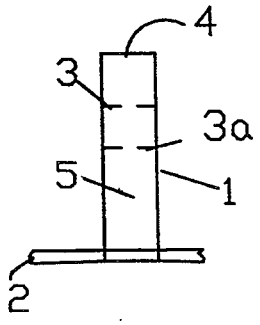
Fig. 1a Prior Art
FIG. 1*a* shows an end view of FIG. 1.
Figure 1B:
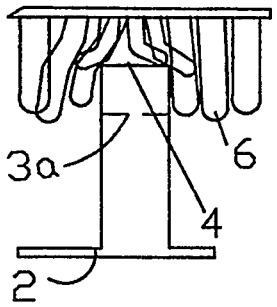
Fig. 1b Prior Art
FIG. 1*b* depicts the hook of FIG. 1*a* penetrating into a loop strip by pushing aside a group of loop elements.

FIG. 1 is a molded hook(1) of the prior art with a base(2), a stem(5), a crook(3), a hook top(4) and a crook tip (3*a*). The hook has a lateral thickness as shown in FIG. 1*a*. This dimension will be referred to as lateral thickness for all hook types described herein. The crook(3) of FIG. 1 and FIG. 1*a* have the same lateral thickness as the stem(5). The crook(3) of FIG. 1 has an additional thickness which is that dimension from the bottom of the crook(3) to the top of the crook(4). This latter dimension is referred to as vertical thickness. This terminology of lateral and vertical thickness is used throughout this application regardless of the type hook being described.

When penetrating into a mass of loops, the hook top(4) pushes aside the fibrous loops(6) which slip below the crook tip(3*a*) and swing under the crook(3). After such action takes place, if an attempt is made to separate the two strips, the loops resting under the crook of the hook are trapped within the crook and the strips can not be separated without bending a crook or breaking the loop. When the hooks restrain loops in the manner described, the strips are considered to be engaged. Usually the number of hooks in a hook and loop strip is substantially less than the number of loops. Therefore, the degree of engagement is considered to be the number of hooks that are engaged relative to the total number of hooks available for engagement. Engagement can be referred to as a percentage of actual hooks engaged to the actual number of hooks present that might be engaged. Percentage engagement will be dependent upon many things, but one factor that plays a major role in engagement is the force applied to press the two elements together, which we refer to as engagement force herein. Generally, the greater the engagement force the higher the percent engagement.

Engagement force itself will depend upon several factors. One very important factor is the shape of the hook. A very broad, flat topped hook would be expected to require more force to push aside the fibers of the loop than a very thin topped hook. Therefore the top of the hook in FIG. 1 being very flat and broad will require considerable force to penetrate into the mass of fibers on the loop strip. In addition the loops are diverted, bent and crushed by the broad top of the hook. One way to maintain the engagement penetration force low is to make the hooks very thin. However, very thin hooks have a tendency to twist and bend and the crook portion of the hook twists out from under the loop rather than bending straight back, a mechanism which provides the maximum efficiency of the hook design.

Figure 2:
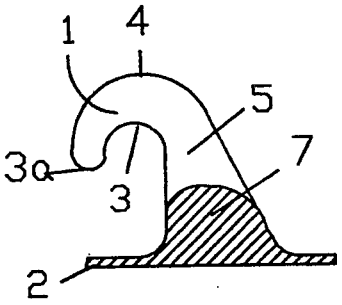
Fig. 2 Prior Art
FIG. 2 shows the hook of FIG. 1 using a side reinforcing section of the hook to enhance tear strength of the hook strip.
Figure 2A:
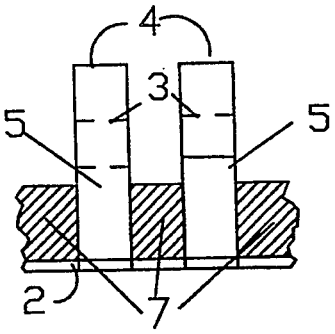
Fig. 2a Prior Art
FIG. 2*a* shows an end view of the hook of FIG. 2 where the reinforcing ribs are continuous in effect connecting the stem portions of multiple hooks.
Figure 3:
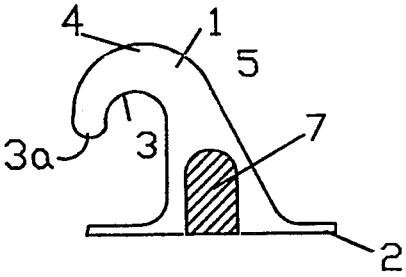
Fig. 3 Prior Art
FIG. 3 shows a hook design according to Murasaki in U.S. Pat. No. 5,131,119 with side reinforcing similar to the rip stops of FIG. 2 but without tracing the general shape nor filling the complete area of the stem of the hook where the reinforcing rib is placed.
Figure 3A:
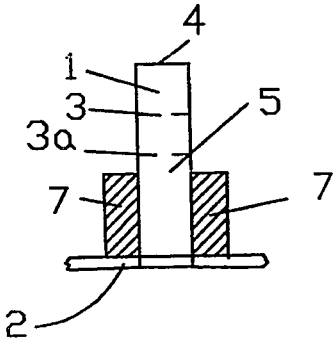
Fig. 3a Prior Art
FIG. 3*a* shows an end view of the hook design according to Murasaki in FIG. 3 with side reinforcing without connecting multiple hooks and the side reinforcing standing on each side of and only connected to a single hook.

A method used to discourage this twisting is to apply reinforcing ribs to the sides of the hook. The hook(1) of FIG. 3 illustrates this technique as described in U.S. Pat. No. 5,131,119 to Murasaki. FIGS. 2 and 2*a* show similar configurations but in this case the reinforcing ribs(7) take on the complete shape of the stem(5) in the area where they reinforce the hook. These ribs(7) are positioned only a short way up the stem(5) of the hook(1). The particular rib configuration, which links together adjacent hooks(l), as shown in FIG. 3*a*, was developed to enhance the tear strength of the strip base(2). The ribs(7) act as rip stops when tear forces are applied to the base(2) of the hook strip. Such rip stops(7), acting essentially the same as the reinforcing ribs(7) of Murasaki, were determined to have a minimal effect on the closure performance of a molded hook strip and do not interfere in any way with engagement of the hook. It was heretofore generally believed important to keep the height of the reinforcing portion of the stem as short as possible in order not to increase engagement force.

FIG. 3*a* depicts an end view of the hook of FIG. 3 showing the reinforcing ribs(7) to proceed only partially up the side of the stem(5) and only covering a small portion of the cross section of the stem(5). Other views from the Murasaki patent, not shown, show thin supporting ribs joining adjacent hooks.

Figure 4:
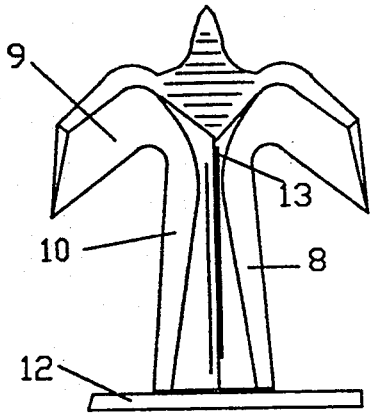
Fig. 4 Prior Art
FIG. 4 depicts the hook of Ribich as disclosed in U.S. Pat. No. 3,708,833 showing a tapered top and angled crook lobe molded from complex molds.
Figure 4A:
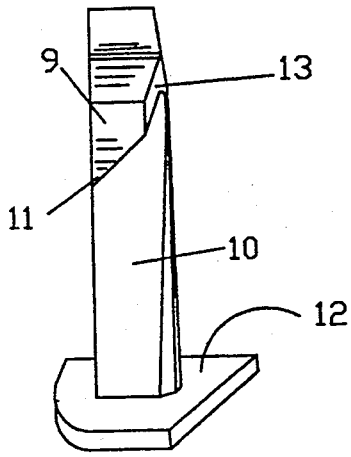
Fig. 4a Prior Art
FIG. 4*a* is a side view of the hook in FIG. 4.

FIG. 4 is a drawing of the hook of Ribich as taken from U.S. Pat. No. 3,708,833. We have observed this hook has an unusual property of being able to engage very efficiently with loops, about which more will be said below. Apparently the slightly tapered top and stem of the hook permit this very advantageous engagement characteristic. However, such designs require elaborate molds to be designed and fabricated at substantial economic penalty. The molds for making such hooks are extremely expensive and it is one object of the instant invention to produce a hook with substantially similar properties as more elaborately molded shapes but with much simpler and less costly shapes to produce.

Figure 5:
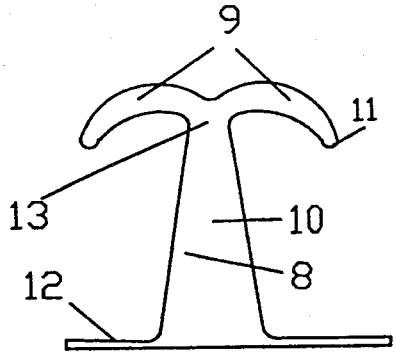
FIG. 5 is a hook showing a base, a stem, a neck and a head, wherein the head has two opposing complementary crooks projecting from the neck, opposing each other and substantially aligned parallel to the long dimension of the base.
Figure 5A:
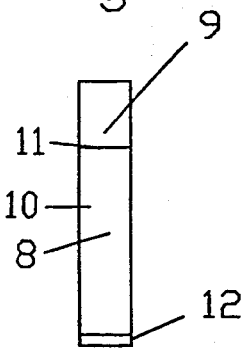
FIG. 5*a* is the side view of the hook of FIG. 5 having a constant thickness throughout the entire element.

FIG. 5 illustrates the cross sectional view of a hook for a hook and loop fastener which has twin crooks as the head of the hook. The crooks are connected through the neck of the hook to the stem and project outward from the neck generally parallel to the base of the hook strip. The crook can be curved to the degree desired to enhance its ability to trap or ensnare loops when the hook is plunged into a mass of fibrous loops. This general shape is often referred to as a "palm tree" hook. Such hooks are formed by injection molding or by extrusion and cross cutting the extruded profile. One method of making such hooks is referred to in the trade as the "cut and stretch" method. In the case of the so called "cut and stretch" methods of forming hooks, hooks must be of substantially uniform thickness from their base throughout the entire cross section due to the action of the cutting blade which forms the hook from a profiled extrusion. Such hooks, whether molded or extruded and cut, have a flat top profile as illustrated by FIG. 5*a*. This flat profile blunts the ability of the hook to penetrate into a mass of loops as illustrated in FIG. 1*a*.

Figure 6:
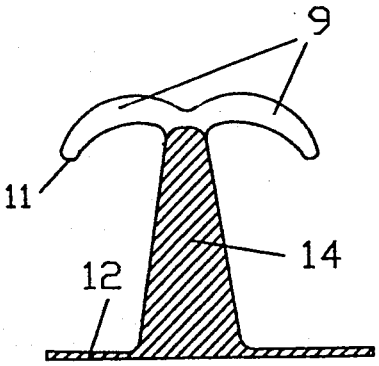
FIG. 6 is a hook showing a base, a stem, a neck and a head, wherein the head has two opposing complementary crooks projecting from the neck, opposing each other and substantially aligned parallel to the long dimension of the base but a broadened stem outlined by the hash-marked area.
Figure 6A:
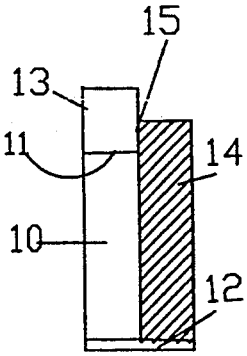
FIG. 6*a* is the hook of FIG. 6 shown from its left side with the broadened stem portion identified in the hash-marked area at the right hand side of the drawing with the head portion attached to the stem at the neck the hook.
Figure 6B:
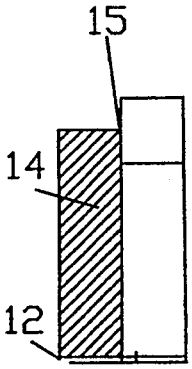
FIG. 6*b* is the hook of FIG. 6 shown from its right side with the broadened stem portion identified in the hash-marked area at the left hand side of the drawing with the head portion attached to the stem at the neck the hook.

FIG. 6 is a face view of a hook of this invention, and FIG. 6*a* and 6*b* are side views of the same hook from the left side and the right side of FIG. 6, respectively. The left hand side(10) of FIG. 6*a* is similar to the palm tree hook of FIG. 5. However, this hook has a much broader stem throughout the entire stem portion and extending up to the neck(15) of the hook. The crook of the hook extends beyond the neck(15) and has a substantially thinner cross section than the stem portion(14). The twin crooks(9) can be of any convenient shape, but I prefer a smooth sweeping curve from the neck continuously decreasing in vertical thickness from the base at the neck(15) to the hook tip(11). A mold cavity for such configuration is easy to produce and such a continuous taper permits withdrawal of the hook without the need for shifting molds or complex mold mechanisms.

Figure 7:
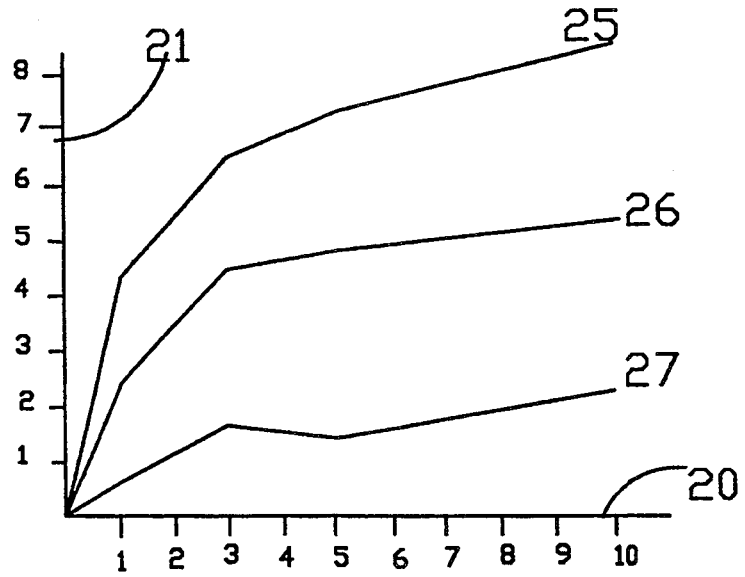
FIG. 7 is a graph showing engagement performance of various hooks illustrating the advantages gained in engageability and performance from the instant invention.

As mentioned above, we have found that the Ribich hook has excellent engaging properties. FIG. 7 is a graph illustrating the beneficial effects of the hook of this invention. The data for this graph are contained in Table I below. The data for this graph were obtained by preparing a jig for an INSTRON tensile tester which has opposed flat platens, one platen having affixed thereto a one inch wide hook strip and the other platen having affixed thereto a one inch wide loop strip. Each platen has attached to its underside a perpendicular projection configured to fit into and be held by the jaws of the tensile tester. A one inch strip of companion element strips are attached to each platen. The platens are affixed to the jaws of the tester in such a manner that the element surfaces of the opposed strips are parallel to each other but the longitudinal direction of each strip are at an angle of ninety degrees to each other such that when the jaws of the tester are closed the elements of the two strips engage in an area of one square inch.

The test is performed by setting the tensile tester so as to close to a predetermined force. That is, after the jaws encounter one another they continue to close until a predetermined force is reached: at which point, the jaws reverse and start to separate. As the jaws separate, the force required to separate the hook from the loop is recorded. The above described procedure is repeated for four different closure forces: one, three, five and ten pounds. The data so obtained is then plotted on the graph shown in FIG. 7. The abscissa(20) of the graph is the force applied to engage the hook and loop elements together while the ordinate(21) depicts the force required to separate the hook and loop closure.

Three curves (25), (26) and (27) are shown on the graph of FIG. 7 The graph line (25), representing data taken for the Ribich hook (FIG. 4), shows a very rapid rise in separation force leveling out at greater than eight pounds after about five pounds compression force. On the other hand, the graph for a standard palm tree hook (FIG. 5) increases its separation force only gradually and still after ten pounds of compression force is unable to reach even three pounds of separation force. The performance of the hook design of the instant invention is depicted by line (26). While it does not achieve the levels of the Ribich hook, it shows substantial improvement in engageability over the standard hook. This is accomplished with a minimum of geometric planes in the hook itself and the hook shape retains its simplicity of design, eliminating the need for complex mold cavity design and permitting one no utilize low cost economical molds. However, I have found that this design not only permits economical mold building, but it also, surprisingly, produces a hook with substantially improved closure performance even beyond the advantages of ease of engagement noted. This improvement in properties is best illustrated by referring to Table I below. The hooks tested include three distinct types similar to the types depicted in FIGS. 4, 5, and 6. The first product is sold by Velcro USA Inc. under the product designation VELCRO MVA-8 and is a similar design to that shown in U.S. Pat. No. 3,708,833 and in FIG. 4. The second product is an experimental product produced by the Velcro Group Corporation Research Engineers and is designated as CFM-8. CFM-8 is a hook essentially identical to the hook in FIG. 5. The third hook depicted is an experimental version of the hook of the instant invention and is designated as CFM-24. It contains the stouter stem carried up to the very neck of the hook with the palm tree crook projecting from the neck substantially parallel to the base of the hook strip.

The three hooks were obtained by molding hooks from a nylon resin from E. I. Dupont & Co. sold under the trade name Zytel. The resin for MVA-8 had a higher melt flow than the resin for either the CFM-8 or the CFM-24 hook. The resin used for the latter two hooks is sold under the designation Zytel FE 4209-HSL.

TABLE I

| | Peel | Shear | Tension | Engageability @ 3# compression |
|---|---|---|---|---|
| MVA-8 | 2.97 | 26.5 | 17.1 | 6.5 |
| CFM-8 | 2.30 | 24.3 | 12.0 | 1.8 |
| CFM-24 | 3.37 | 36.0 | 16.3 | 4.5 |

Figure 9:
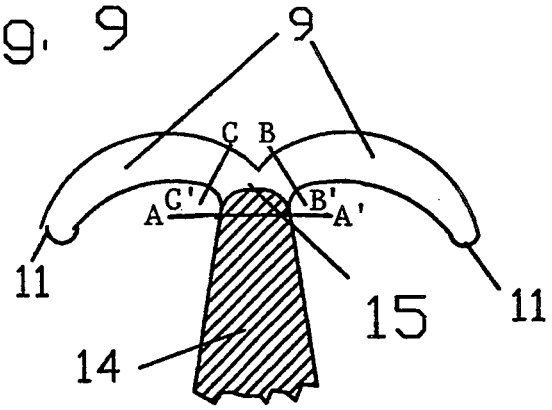
FIG. 9 illustrates a front view of the neck and head portion of the hook of FIG. 6, with section lines showing the cross section portion at the base of each crook and the throat of the neck of the hook and the thickened portion of the stem shown in the hashed-mark area.
Figure 9A:
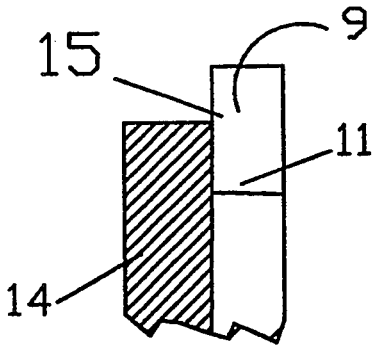
FIG. 9*a* is a right hand side view of FIG. 9 with the thickened stem portion depicted in the hash-marked area.
Figure 10:
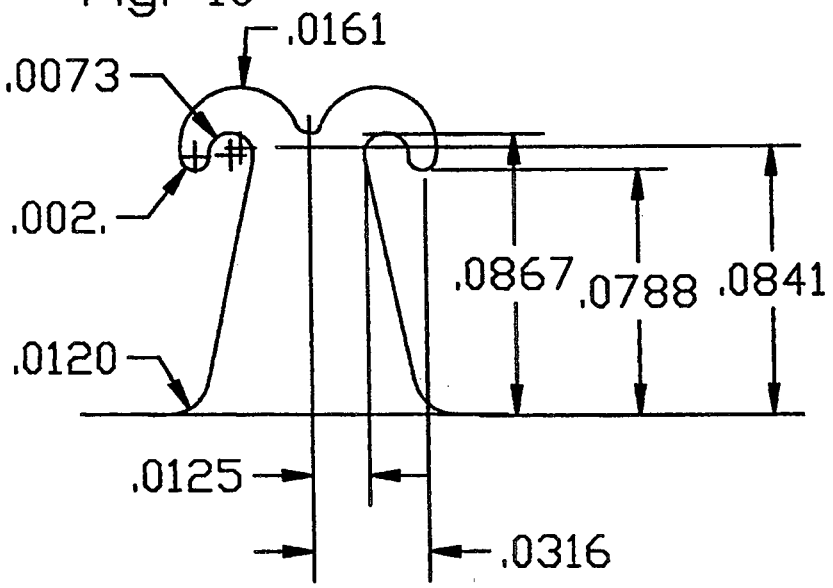
FIG. 10 is a view of the entire hook of the instant invention with specific dimensions shown to illustrate the best mode design for the hook and for which performance data are provided.
Figure 11:
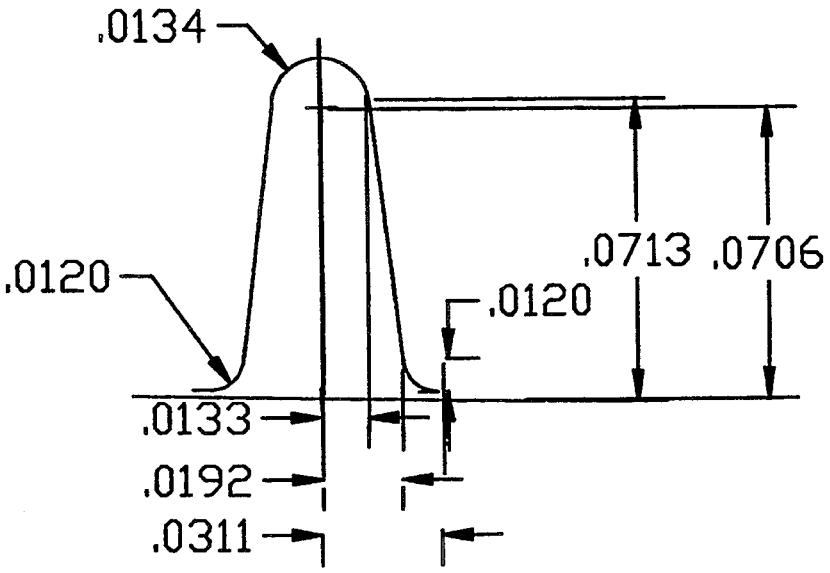
FIG. 11 is a view of only the thickened stem portion of the hook of the instant invention, if such a portion were separate and alone, with specific dimensions shown to illustrate the best mode of the invention and also illustrating the method by which the thickened portion of the stem is fitted to the overall hook design.
Figure 12:
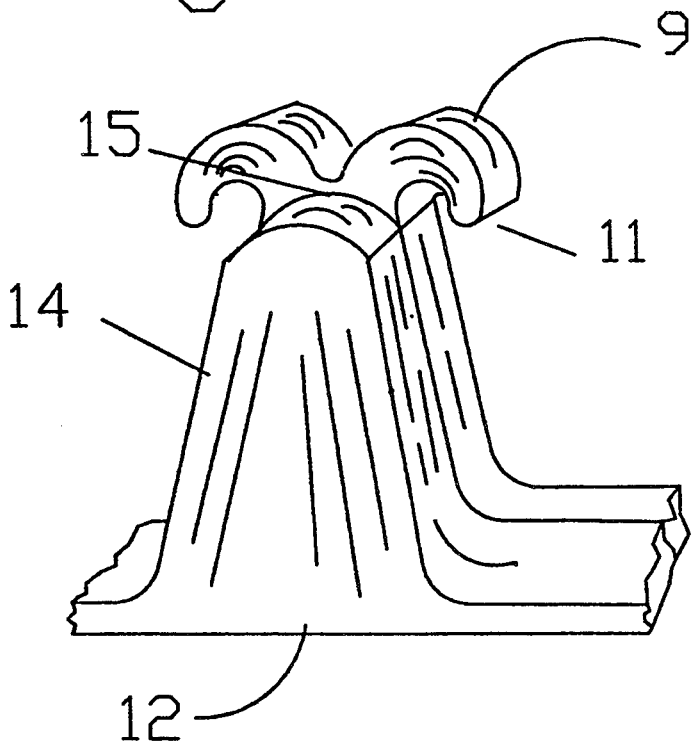
FIG. 12 is an isometric view of the hook of this invention illustrating the relationship of the crook portion to the thickened stem portion and how they are configured together at the neck of the hook.
Figure 13:
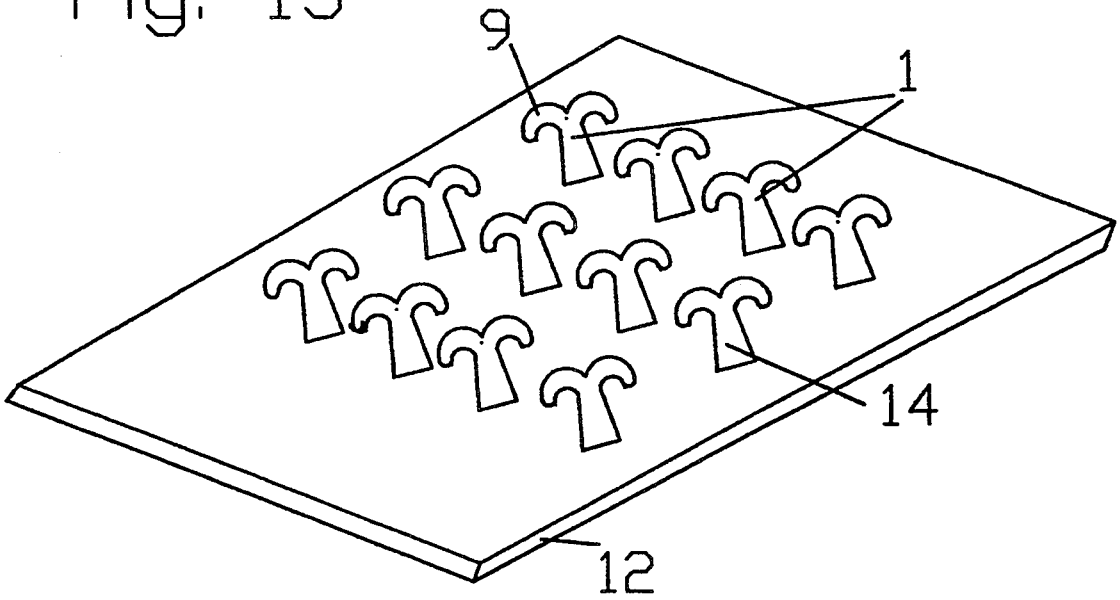
FIG. 13 is a depiction of a fastener strip showing a multiplicity of hooks positioned on a base.

It should be noted the hook designated as CFM-8 differs from the hook designated CFM-24 essentially in the width of the stem. The crook portion of the hooks are essentially the same. While one might expect the increase in shear strength from the broadened stem the increase in tension and peel would not be so expected. We believe this increase is primarily due to the positioning of the broadened stem up to the very neck of the hook. FIG. 9 illustrates more exactly the ideal positioning of the broadened stem(14) at the neck of the hook(15) which is where the two crook lobes of the hook project outward from the stem. FIG. 12 is an isometric view of a hook of this invention showing the relationship of the broadened stem, neck and crook of the hook. FIG. 13 shows a multiplicity of hooks positioned on a common base with a spaced apart relationship. The spacing should be sufficient to permit loops to penetrate between the hooks. The specific spacing is not critical but the strength of a given hook is multiplied by the number of hooks present in a given area. However, the greater the number of hooks the greater amount of material will be needed to form a given area of strip fastener. The fastener designer has a broad latitude in choosing the spacing to achieve a given closure performance.

Figure 8:
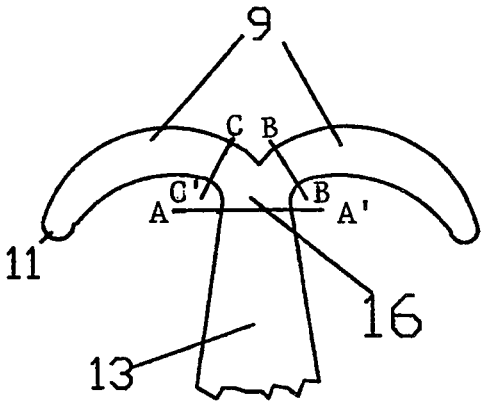
FIG. 8 illustrates the frontal view of the neck and head portion of the hook of FIG. 5, with section lines showing the cross section portion at the base of each crook and the throat of the neck of the hook.
Figure 8A:
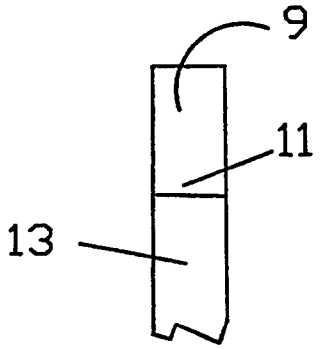
FIG. 8*a* illustrates the side view of the neck and head portion of FIG. 5*a*.

In designing hooks (such as the prior art hook shown in FIG. 1) so they can be created in simplified molds without the need for complex mold mechanisms, the crook lobes are customarily tapered so that no undercut occurs anywhere along the withdrawal path from the mold cavity. Any such undercut would inhibit withdrawal of the hook from the mold cavity. Providing such taper is relatively easily done with single lobe crook hooks because the taper is one continuous taper from the crook tip to the bottom of the stem where it joins the base. However, when developing double lobe crook hooks it is important that the dimension of the neck is sufficiently wide to accommodate the breadth of the two lobes as they are being withdrawn. In FIG. 8 the thickest portion of the crook lobes is at the point where they join(16). The width of the neck at this point is the width along lines B–B′ and C–C′. It is important that the dimension of the neck A–A′ be approximately equal to the sum of the vertical thickness B–B′+C–C′. While some small amount of squeezing of the polymer is permissible as the hook is withdrawn from the mold cavity, a neck width substantially less than the combined vertical thickness of the two lobes will create a restriction which will cause the lobes to break off as the hook is pulled from the mold cavity. Or, if the polymer is not sufficiently solidified, the crook portion will be distended as it is pulled through an opening that is too narrow. If such narrowing occurs the closure strength of the hook will not be as intended when the original dimensions of the hook were established.

By creating the broadened stem(14), up to the very neck(15) of the hook where the two lobes(9) meet, the broadened stem(14) provides support for the base of the crook lobes which enhances their ability to resist being deformed during separation from a loop element. However, even though the crook lobes are reinforced by the extension of the broadened stem they are not inhibited in any way from withdrawal from the mold cavity. No undercuts are formed by extending the broadened stem in this way. Thus, there is no restriction limiting the removal of the hook from a mold cavity. In this manner one is able to achieve the advantages of reinforcing the crook lobes without having to include reinforcing elements that will restrict removal, but at the same time use a hook top which has a thinner profile than would otherwise be required for the hook strength desired. The relatively thinner profile of the hook top permits enhanced engageability of the hook into a mat of dense loops and thus accomplishes improved closure performance while providing ease of engagement. This combination of the thickened stem, reaching completely up to the point on the neck from which the crook lobes project outward, and the thinner crook lobes, provides a hook with substantially improved engaging characteristics coupled with substantially improved closure performance.

Figure 14:
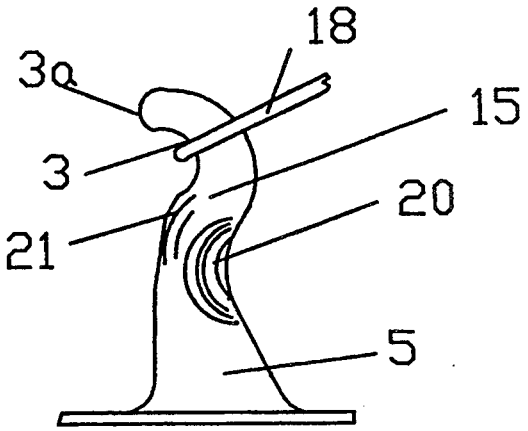
Fig. 14 Prior Art
FIG. 14 is the hook of FIG. 1 illustrated in a position where the crook is deflected into an open position by a loop.
Figure 15:
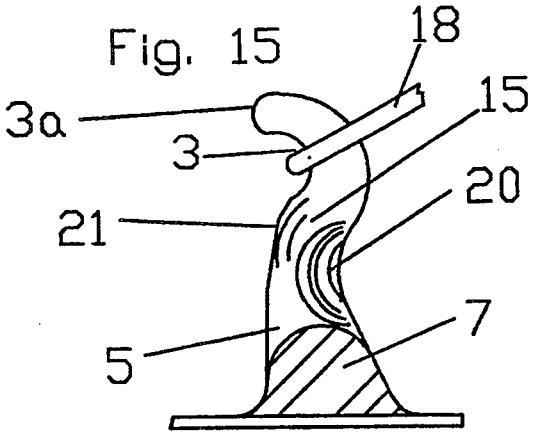
FIG. 15 is the hook of FIG. 2 illustrated in a position where the crook is deflected into an open position by a loop.

It is clear, the performance of the enlarged stem hook is superior to a hook of uniform overall dimensions. While it in no way affects the validity of this invention nor is the invention dependent thereon, we believe the following explanation is helpful in understanding why such design imparts such superior performance. It is not difficult to realize that shear strength should be increased as the stem thickness increases. The thicker the stem the greater the mass of material resisting deflection and therefore the greater the force required to bring about deflection. A loop engaging low down on the stem exerts its force parallel to the base and tends to exert its force on the stem rather than upon the crook. A thickened stem hook, therefore, will perform at a higher shear force, Such an explanation, however, would not seem to apply to deflection of the crook which is of less thickness. As explained above, the top flat profile (lateral thickness) of the crook portion affects the ability of the hook to penetrate a mass of loops. Also, the ability of a crook to withstand deformation is greater with greater lateral thickness. FIG. 14 is the hook of FIG. 1 shown in a stressed condition. Finite element analysis (FEA) shows that the stress concentration occurring in such a hook configuration, when stressed by a loop (18), will lie within but near the top of the stem portion. A point on the inside of the stem(21) is stressed in tension, and a point on the outside of the stem(20) is stressed in compression. FIG. 14 illustrates stress concentration lines within the hook stem. FIG. 15 illustrates the hook of the prior art where a reinforcing section, or thicker stem, is configured part way up the stem. However, the reinforced section lies well below the stress concentration points (20) and (21) of the stem.

Figure 16:
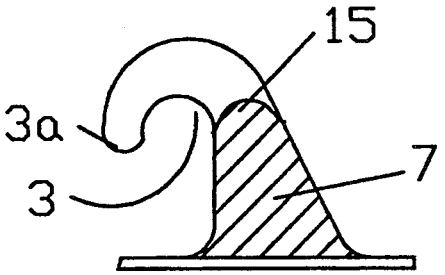
FIG. 16 is a single lobed hook of the present invention where a thickened stem projects from the base up to the neck of the hook and beyond the point of stress concentration on the stem.
Figure 17:
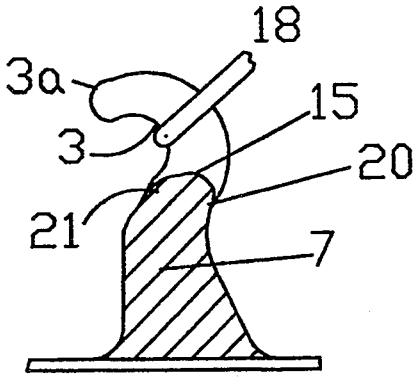
FIG. 17 is the hook of FIG. 16 illustrated in a position where the crook is deflected into an open position by a loop.

FIG. 16 is an illustration of a single crooked hook where the broadened stem is positioned from the flat base all the way up to the neck(15) of the hook(1) where the crook(3) projects outward from the stem(7). FIG. 17 is the hook of FIG. 16 in its stressed mode showing that the top of the broadened portion of the stem projects above the stress concentration points(20) and (21). By extending the broadened stem, or a reinforcing of the stem, to a point above where stress concentration occurs upon deflection of the hook, the force necessary to deflect the crook or crooks of the hook are increased. When these deflection forces are increased, both the peel force and tension force of the fastener strip are also increased.

In designing a hook that has a reduced profile along its upper flat portion it is possible to achieve improved performance by thickening the stem up to or above the deflection or buckle point of the hook. If the points where stress concentration occurs are thicker than the tops of the crook portion, one is able to realize improved penetration into a mat of loops and still generate increased deflection forces on the crook which in turn translates into improved closure performance.

We claim:

1. An improved plastic molded hook for a hook and loop closure system comprising:

a substantially flat base;

a stem having a width and a lateral thickness, the stem connected to and projecting upwards from the base;

a neck portion positioned at the top of the stem, having substantially the same width as the stem and a crook having a base, a tip, a lateral thickness and a vertical thickness, comprising at least one lobe projecting longitudinally outwards from the neck in a plane generally parallel to the base and aligned vertically with a plane in which the stem is aligned;

the stem portion having substantially greater lateral thickness than the crook portion.

2. The hook of claim 1 wherein the stem is at least two times the lateral thickness of the crook.

3. The hook of claim 1 wherein the crook lobe forms a continuously decreasing taper from the neck to the lobe tip.

4. The hook of claim 3 wherein the crook tip is below the neck.

5. A hook strip for a hook and loop closure system containing a multiplicity of hooks projecting from a common base, each individual hook having the design of claim 1.

6. An improved plastic molded hook for a hook and loop closure system comprising:

a substantially flat base;

a stem having a width and a lateral thickness, the stem connected to and projecting upwards from the base;

a neck portion positioned at the top of the stem, and a crook having a base, a tip, a lateral thickness and a vertical thickness, comprising at least one lobe projecting longitudinally outwards from the neck in a plane generally parallel to the base, the stem portion having substantially greater lateral thickness than the crook portion wherein the thickened stem has its thickness greater than the thickness of the crook on only one side of the stem.

7. A hook strip for a hook and loop closure system containing a multiplicity of hooks projecting from a common base, each individual hook having the design of claim 6.

8. An improved plastic molded hook of generally palm tree shape for a hook and loop closure system comprising:

a substantially flat base;

a stem having a width and a lateral thickness, the stem connected to and projecting upwards from the base;

a neck positioned at the top of the stem;

a crook comprising two lobes, each lobe having a crook base, a crook tip, a lateral thickness, and a vertical thickness; the crook projecting forward and rearward from the neck in a path generally parallel to the base; each lobe constructed in a continuously decreasing taper from the crook base to the crook tip; the stem having substantially greater lateral thickness than the crook: the stem constructed in a continuously decreasing width from its base to the neck; the neck having a width at least equal to two times the vertical thickness of a crook lobe at its thickest point whereby the hook can be easily withdrawn from its mold after the molding process.

9. A hook strip for a hook and loop closure system containing a multiplicity of hooks projecting from a common base, each individual hook having the design of claim 8.

10. An improved plastic molded hook of generally palm tree shape for a hook and loop closure system comprising:

a substantially flat base;

a stem having a width and a lateral thickness, the stem connected to and projecting upwards from the base;

a neck portion connected to the stem;

a crook comprising two lobes, each lobe having a crook base, a crook tip, a lateral thickness, and a vertical thickness; the crook projecting forward and rearward from the neck in a path generally parallel to the base; each lobe constructed in a continuously decreasing taper from the crook base to the crook tip; the stem having substantially greater lateral thickness than the crook up the neck; the neck positioned above a point on the stem where stress concentration occurs when a lobe of the crook is opened by a loop during separation of a loop from a hook; the stem tapered in a continuously decreasing width from its base to the neck; the neck having a width at least equal to two times the vertical thickness of a crook lobe at its thickest point whereby the hook can be easily withdrawn from its mold after the molding process.

11. A hook strip for a hook and loop closure system containing a multiplicity of hooks projecting from a common base, each individual hook having the design of claim 10.

12. An improved plastic molded hook for a hook and loop closure system comprising:

a substantially flat base;

a stem having a width and a lateral thickness, the stem connected to and projecting upwards from the base;

a neck portion connected to the stem, a crook comprising two lobes, each lobe having a crook base, a crook tip, a lateral thickness and a vertical thickness, the crook projecting forward and rearward from the neck in a path generally parallel to the base, each lobe constructed in a continuously decreasing taper from the crook base to the crook tip; the stem having substantially greater lateral thickness than the crook, up to the neck; the neck positioned above the point on the stem where stress concentration occurs when a lobe of the crook is opened by a loop during separation of a loop from a hook; the stem tapered in a continuously decreasing width from its base to the neck; the neck having a width at least equal to two times the vertical thickness of a crook lobe at its thickest point whereby the hook can be easily withdrawn from its mold after the molding process wherein the thickened stem has its thickness greater than the thickness of the crook on only one side of the stem.

13. A hook strip for a hook and loop closure system containing a multiplicity of hooks projecting from a common base, each individual hook having the design of claim 12.

14. The hook of claim 12 wherein the stem portion that has a greater lateral thickness than the crook portion, terminates in a smooth rounded curve from the sides of the stem to the midpoint of the neck.

* * * * *